US006283895B1

(12) United States Patent
Stearns et al.

(10) Patent No.: US 6,283,895 B1
(45) **Date of Patent: *Sep. 4, 2001**

(54) SEMI-RECUMBENT EXERCISE APPARATUS WITH ELLIPTICAL MOTION

(76) Inventors: Kenneth W. Stearns, P.O. Box 55912, Houston, TX (US) 77055; Joseph D. Maresh, P.O. Box 645, West Linn, OR (US) 97068-0645

( * ) Notice: Subject to any disclaimer, the term of this patent is extended or adjusted under 35 U.S.C. 154(b) by 0 days.

This patent is subject to a terminal disclaimer.

(21) Appl. No.: 09/597,178

(22) Filed: Jun. 20, 2000

(51) Int. Cl.[7] ..... A63B 69/06; A63B 21/00
(52) U.S. Cl. ..... 482/52; 482/51
(58) Field of Search ..... 482/51, 52, 53, 482/57, 70, 79, 80, 142, 62, 71, 60, 63

(56) References Cited

U.S. PATENT DOCUMENTS

| | | | | |
|---|---|---|---|---|
| 5,836,855 | * | 11/1998 | Eschenbach | 482/57 |
| 5,938,570 | * | 8/1999 | Maresh | 482/52 |
| 6,017,295 | * | 1/2000 | Eschenbach | 482/52 |
| 6,077,197 | * | 6/2000 | Stearns et al. | 482/52 |

* cited by examiner

*Primary Examiner*—Stephen R. Crow

(57) ABSTRACT

A semi-recumbent cycling apparatus constrains left and right foot supports to move through substantially elliptical paths of motion relative to a frame, while supporting a person's back in an inclined position relative to an underlying floor surface. The paths of the foot supports have major axes which extend generally perpendicular to the floor surface.

20 Claims, 8 Drawing Sheets

SEMI-RECUMBENT EXERCISE APPARATUS WITH ELLIPTICAL MOTION

FIELD OF THE INVENTION

The present invention relates to exercise methods and apparatus and more particularly, to a semi-recumbent cycling machine which facilitates foot movement through an elliptical path.

BACKGROUND OF THE INVENTION

Cycling machines are known in the art. In general, a person sits on a seat and faces toward handle bars with legs extending downward. With the feet on respective pedals, the person is able to move his or her legs through a continuous motion. However, shortcomings associated with this type of exercise include a relatively limited range of motion and lack of back support during exercise. The art is also replete with recumbent cycling machines, which provide requisite back support but provide the same limited range of motion. An object of the present invention is to provide an exercise apparatus which provides comfortable back support while facilitating exercise through a continuous path of motion having an extended range.

SUMMARY OF THE INVENTION

In one respect, the present invention may be seen to provide a novel linkage assembly and corresponding exercise apparatus suitable for linking circular motion to relatively more complex, generally elliptical motion. In particular, an intermediate portion of a connector link is rotatably connected to a crank; a first end of the connector link is sized and configured to support a person's foot; and a second, opposite end of the connector link is constrained to move through a fixed path. The arrangement links rotation of the flywheel to movement of the foot support through a generally elliptical path.

In another respect, the present invention may be seen to provide a novel exercise apparatus which supports a person in an inclined and supine position relative to a horizontal floor surface while facilitating movement of the person's feet through generally elliptical paths having major axes which are generally perpendicular to the floor surface. In this regard, the linkage assembly components are configured and arranged to facilitate exercise which is safe, comfortable, and effective.

In yet another respect, the present invention may be seen to provide a novel exercise apparatus which facilitates foot travel through any of several fixed elliptical paths. In this regard, the constraint imposed on the second end of the connector link is moved relative to the crank axis to adjust the exercise stroke. Many of the features and advantages of the present invention may become more apparent from the detailed description that follows.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

Figure 1:
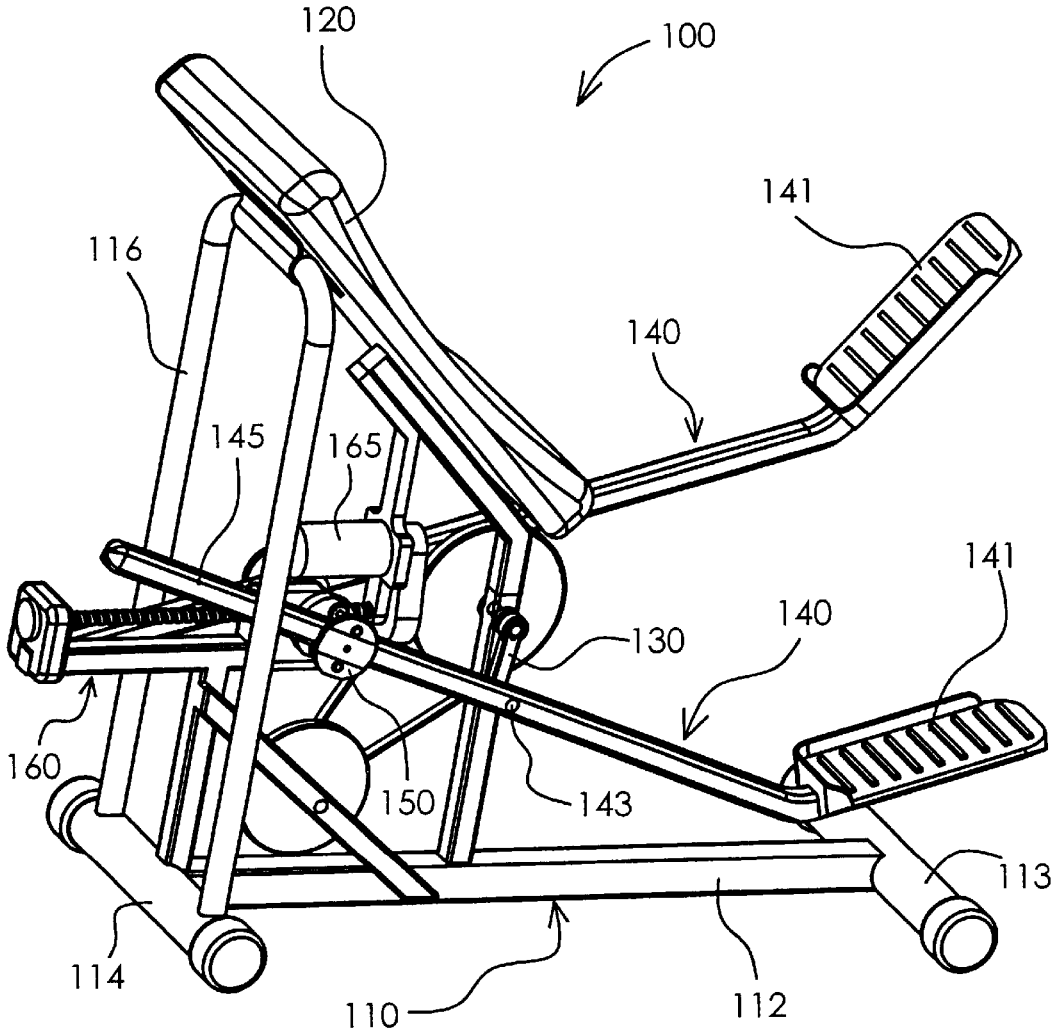
FIG. 1 is a perspective view of an exercise apparatus constructed according to the principles of the present invention.
Figure 2:
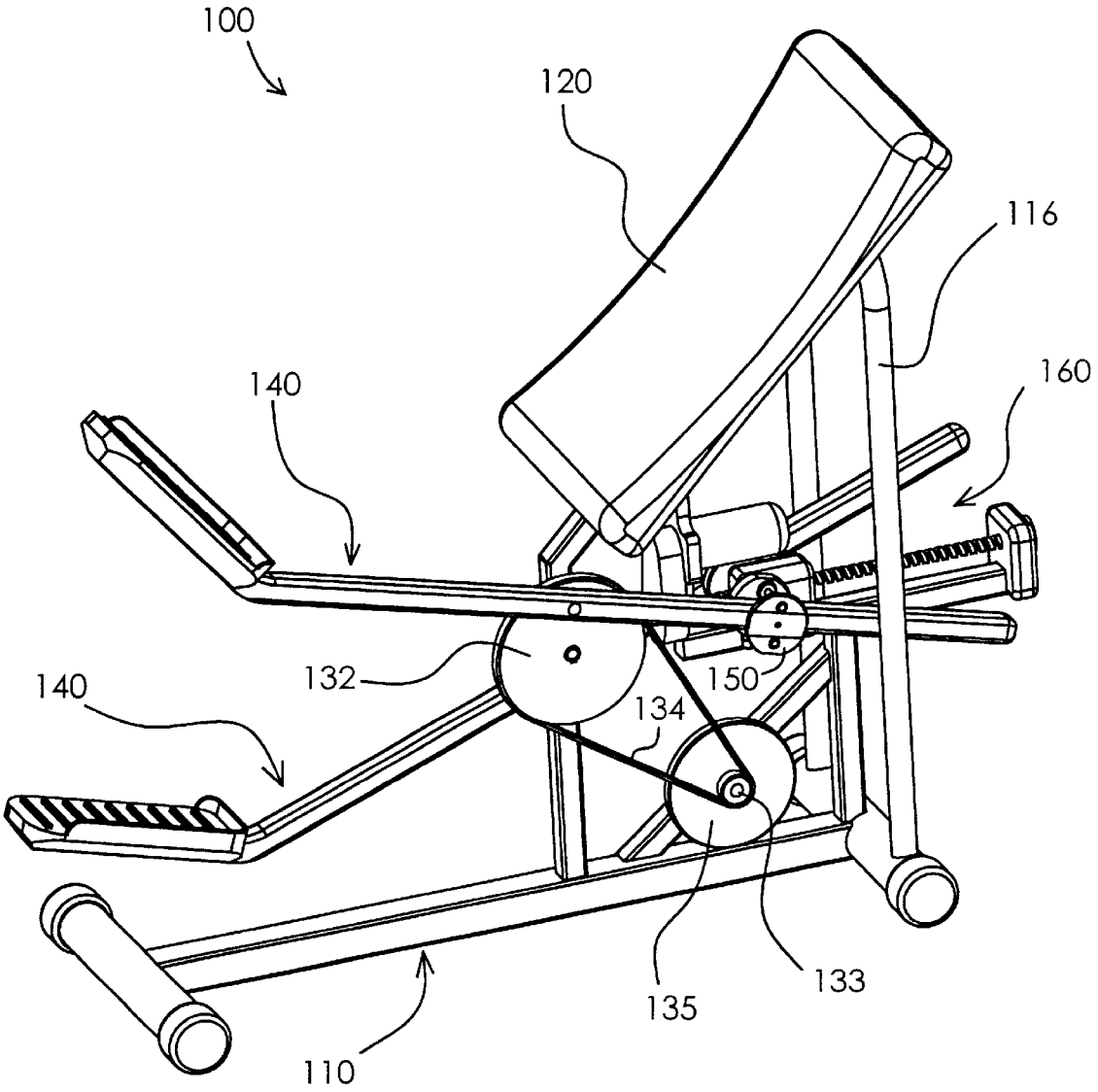
FIG. 2 is another perspective view of the exercise apparatus of FIG. 1.
Figure 3:
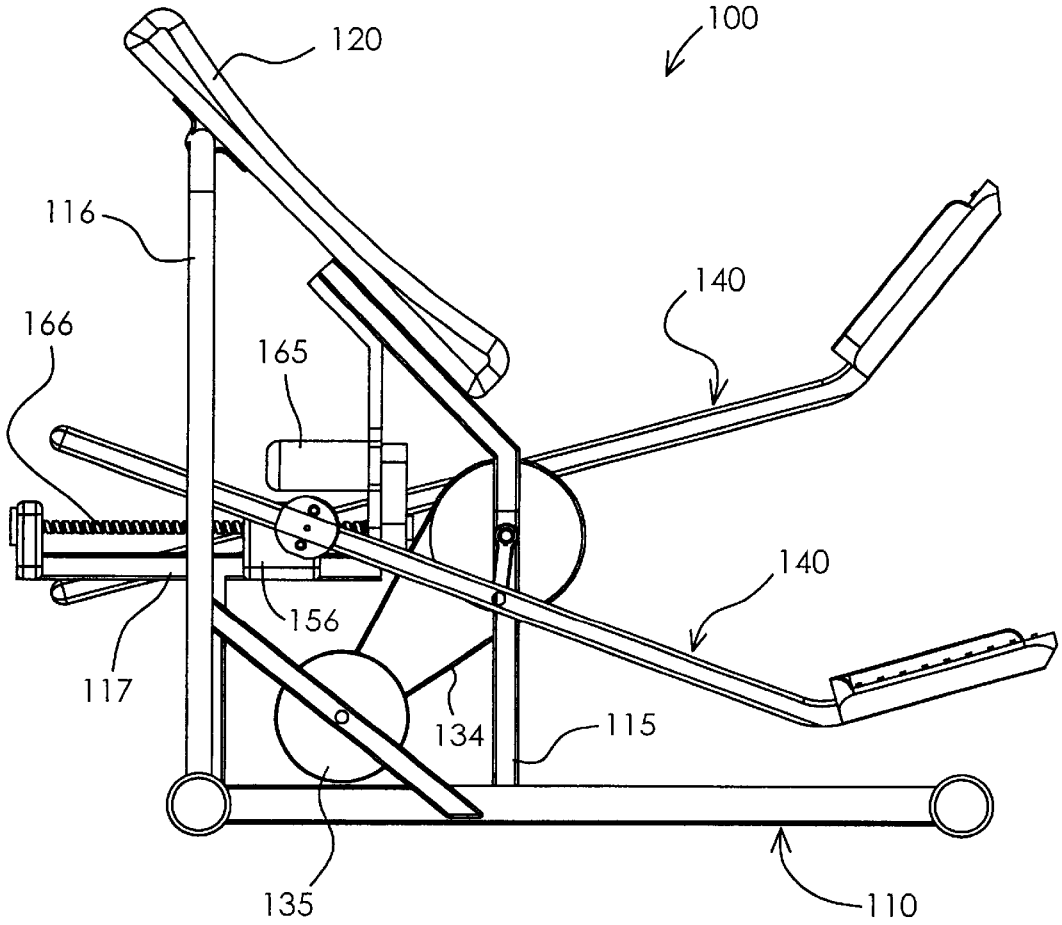
FIG. 3 is a side view of the exercise apparatus of FIG. 1.

The present invention provides a leg exercise assembly which moves relative to a frame in a manner that links rotation of left and right cranks to generally elliptical motion of respective left and right foot supporting members. The term "elliptical motion" is intended in a broad sense to describe a closed curved path of motion having a relatively longer first axis or major axis and a relatively shorter second axis or minor axis.

A first exercise apparatus constructed according to the principles of the present invention is designated as 100 in FIGS. 1–6. The apparatus 100 includes a leg exercise assembly which moves relative to a frame 110 in a manner that links rotation of right and left cranks 130 and 132 to generally elliptical motion of respective right and left foot supporting members 141.

The frame 110 includes a base 112 which is designed to rest upon a generally horizontal floor surface. The apparatus 100 is generally symmetrical about a vertical plane extending lengthwise through the base 112. The linkage assembly has like parts on each side of the plane of symmetry, but the parts are one hundred and eighty degrees out of phase with one another. Nonetheless, like reference numerals are used to designate both the "right-hand" and "left-hand" components of the linkage assembly, and when reference is made to linkage assembly parts on only one side of the apparatus 100, it is to be understood that similar parts are disposed on the opposite side of the apparatus 100.

The base 112 includes a forward end which coincides with a transversely extending support 113; a rearward end which coincides with a transversely extending support 114; an intermediate frame portion 115 extending upward from the base 112; and a rear frame portion 116 extending upward from the base 112. An inclined body support 120 is mounted on top of both frame portions 115 and 116 and is oriented at an angle of approximately one hundred and thirty-five degrees relative to the base 112 and the underlying floor surface. The body support 120 is sized and configured to support a person's head, back, and posterior. The body support 120 is rigidly mounted on the frame 110, but provisions could be made for adjusting the position of the former relative to the latter to accommodate people of different sizes and/or having different needs.

Figure 4:
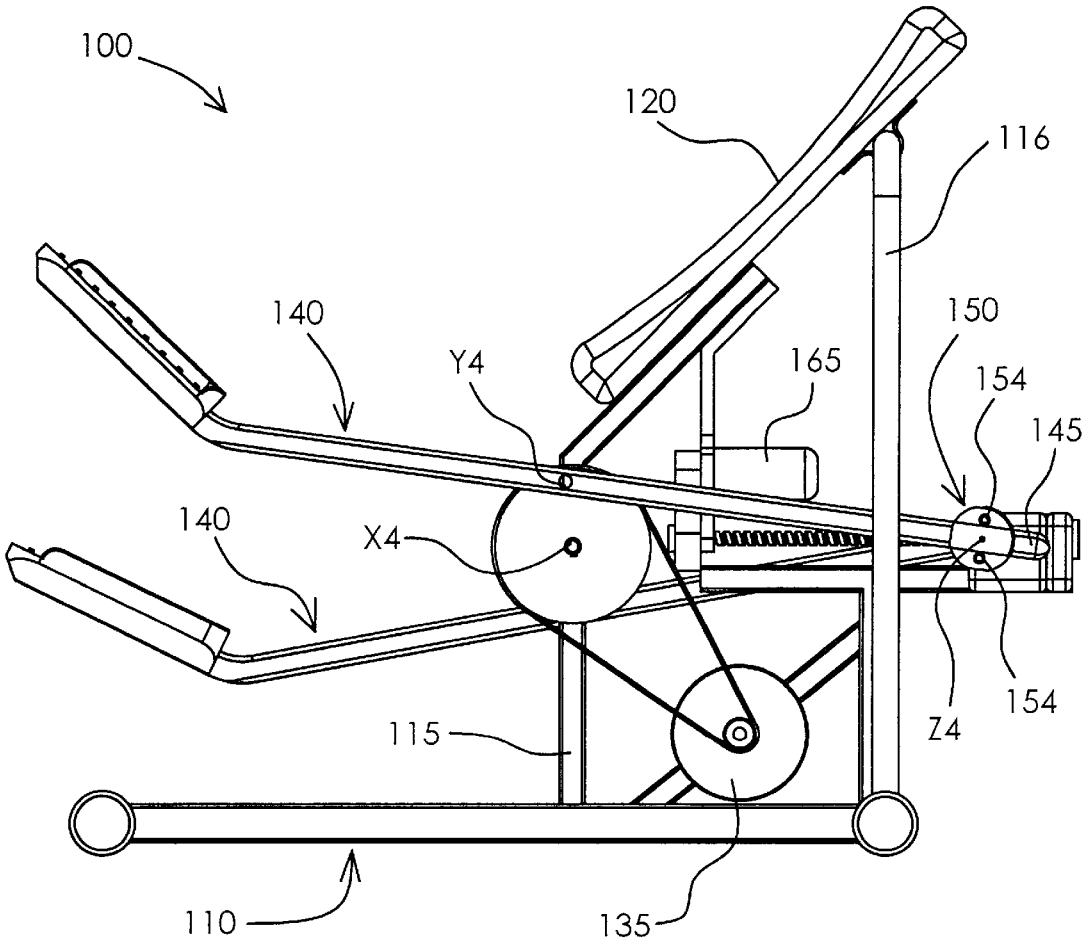
FIG. 4 is an opposite side view of the exercise apparatus of FIG. 1, the apparatus having been adjusted to generate a relatively shorter exercise stroke.
Figure 5:
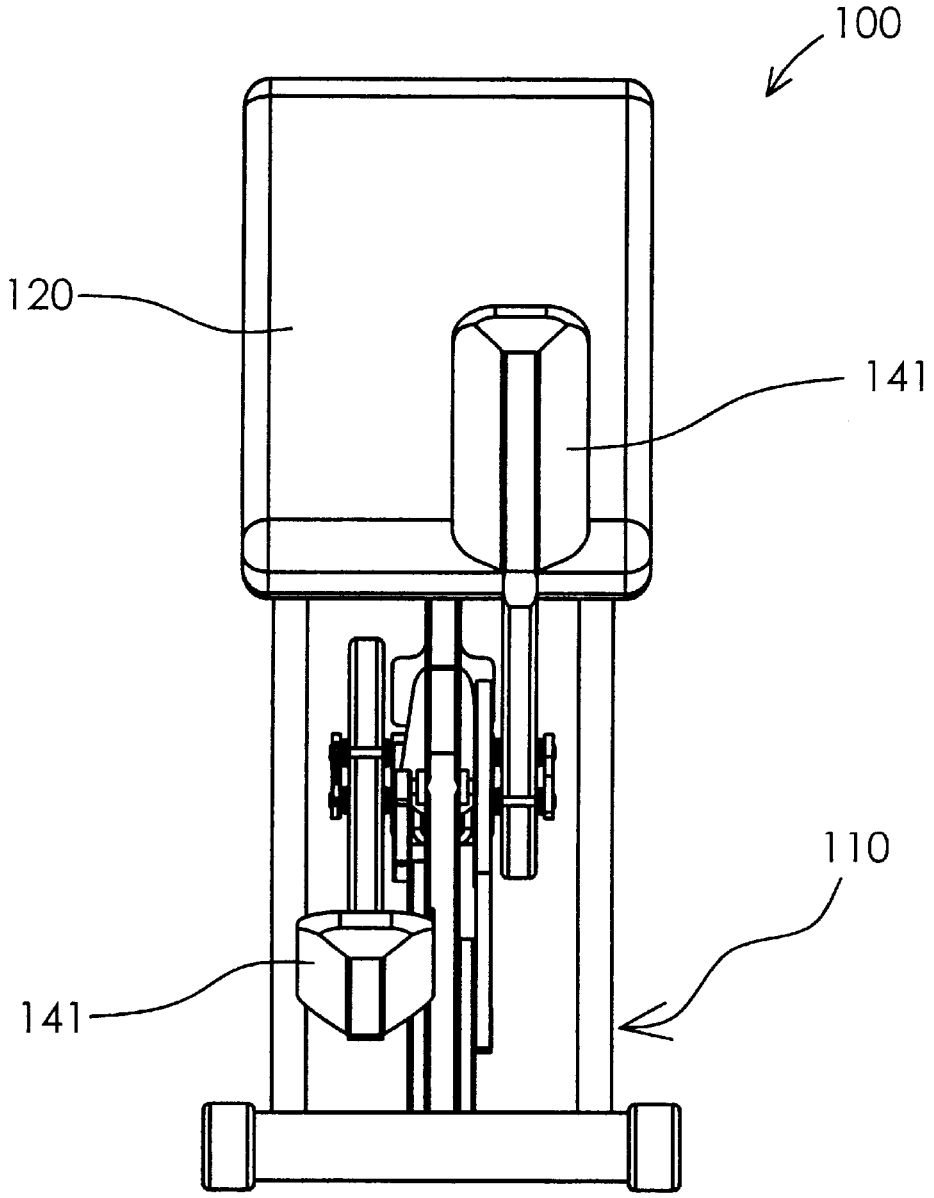
FIG. 5 is a front view of the exercise apparatus of FIG. 1.
Figure 6:
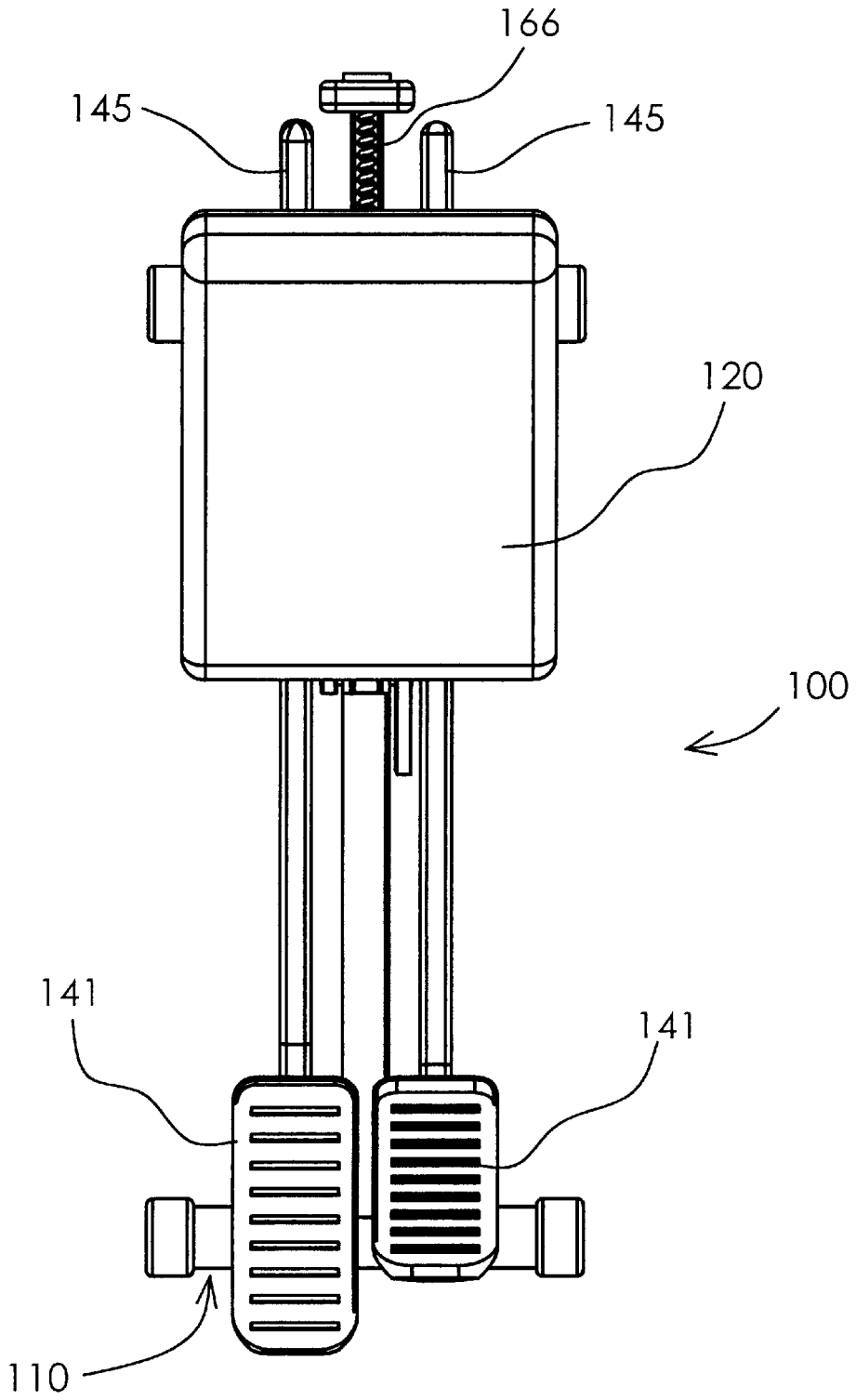
FIG. 6 is a top view of the exercise apparatus of FIG. 1.

Right and left cranks 130 and 132 are rotatably mounted to the frame portion 115 by means known in the art. The right crank 130 is depicted as a crank arm, and the left crank 132 is depicted as a relatively large diameter pulley. As shown in FIG. 4, the cranks 130 and 132 rotate about a common crank axis X4 relative to the frame 110. A flywheel 135 is rotatably mounted to the frame portion 115 by means known in the art. A belt 134 is formed into a closed loop about the pulley 132 and a relative small diameter pulley 133 which is secured to the flywheel 135 and/or the flywheel shaft. As a result of this arrangement, the flywheel 135 is "stepped up" relative to the cranks 130 and 132 and rotates relatively faster than the cranks 130 and 132. Those skilled in the art will recognize that other known types of inertia altering mechanisms (including, for example, a drag strap resistance device) may be added to or substituted for the stepped up flywheel arrangement.

Right and left connector links 140 have intermediate portions 143 which are rotatably connected to distal ends of respective cranks 130 and 132. As shown in FIG. 4, each connector link 140 is thereby constrained to pivot about a respective axis Y4 relative to a respective crank 130 or 132. A forward end of each link 140 supports a respective foot platform 141 which is sized and configured to support a person's foot. Each foot support 141 defines an angle of approximately one hundred and forty-five degrees relative to the longitudinal axis of a respective connector link 140.

The connector links 140 have rearward ends 145 which are movably connected to the frame 110. In particular, right and left constraints 150 are rotatably mounted on opposite sides of a block 156, and each constraint 150 is provided with a pair of opposing bearing members 154. As shown in FIG. 4, the constraints 150 rotate about a common "guide" axis Z4 relative to the block 156. The rearward ends 145 of the connector links 140 are constrained to rotate about the axis Z4 (together with respective constraints 150) but are free to move in a radial direction relative to both the axis Z4 and the constraints 150. As a result, rotation of the cranks 130 and 132 is linked to rotation of the connector link ends 145 together with the constraints 150 and translation of the connector link ends 145 relative to the constraints 150 and to generally elliptical movement of the foot supports 141 relative to the frame 110. The relative sizes and spacial relationships of the parts shown in FIGS. 1–6 result in a very desirable exercise stroke.

The magnitude of the exercise stroke (the path traveled by the foot supports 141) may be adjusted by moving the block 156 (and the guide axis Z4) relative to the crank axis X4. On the embodiment 100, the adjustment means 160 includes a motor 165 which selectively rotates a worm gear 166. The block 156 is operatively connected to the worm gear 166 and constrained to move along a rail 117 on the frame portion 115 in response to rotation of the worm gear 166. Rotation of the worm gear 166 in a first direction causes the block 156 to move forward toward the relatively long stroke position shown in FIG. 3. Rotation of the worm gear 166 in a second, opposite direction causes the block 156 to move rearward toward the relatively short stroke position shown in FIG. 4.

Those skilled in the art will recognize that each of the components of the linkage assembly is necessarily long enough to facilitate the depicted interconnections but need not terminate immediately beyond the points of connection. Furthermore, for ease of reference in both this detailed description and the claims set forth below, the components are sometimes described with reference to "ends" being connected to other parts. However, a term such as "rear end" should be interpreted broadly, in a manner that could include "rearward portion" and/or "behind an intermediate portion", for example. Those skilled in the art will further recognize that the components of the linkage assembly may be arranged and/or interconnected in a variety of ways without departing from the scope of the present invention, and that the spatial relationships, including the radius and/or angular displacement of the crank axes, may vary for different sizes, configurations, and/or arrangements of the components of the linkage assembly.

Figure 7:
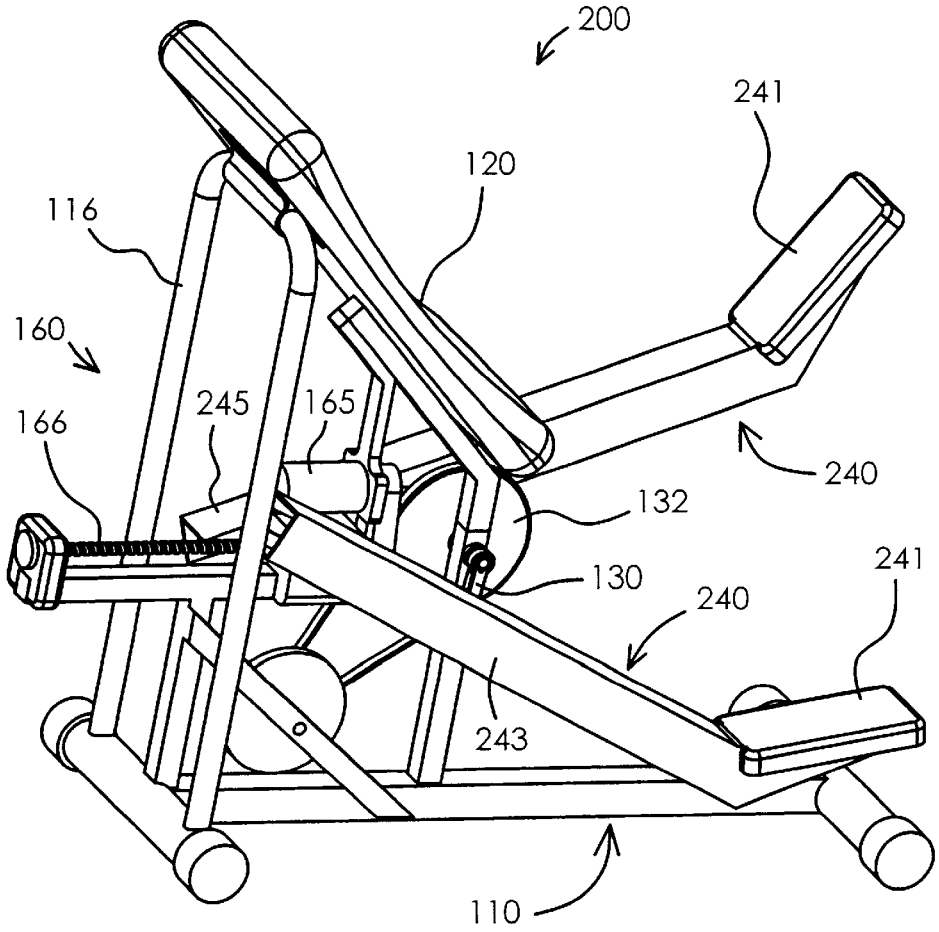
FIG. 7 is a perspective view of another exercise apparatus constructed according to the principles of the present invention.
Figure 8:
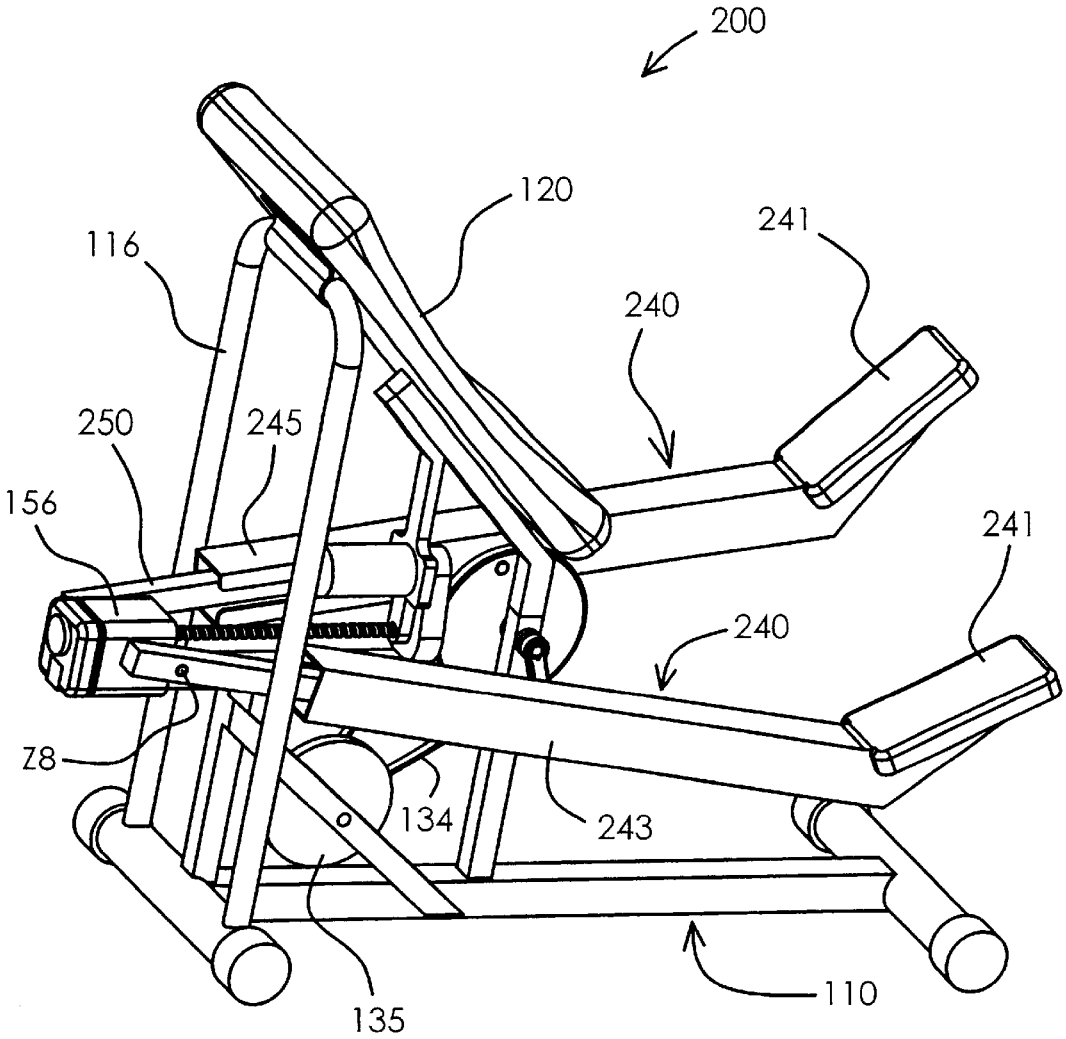
FIG. 8 is another perspective view of the exercise apparatus of FIG. 7, the apparatus having been adjusted to generate a relatively shorter exercise stroke.

One such modification of the present invention is the alternative embodiment exercise apparatus which is designated as 200 in FIGS. 7–8. As suggested by the common reference numerals, this second embodiment 200 is similar in some respects to the first embodiment 100. A similar body support 120 and a similar crank arrangement, including cranks 130 and 132, are mounted on a similar frame 110.

Right and left connector links 240 have intermediate portions 243 which are rotatably connected to distal ends of respective cranks 130 and 132. As a result, each connector link 240 is constrained to pivot about a respective axis relative to a respective crank 130 or 132. A forward end of each link 240 supports a respective foot platform 241 which is sized and configured to support a person's foot. Each foot support 241 defines an angle of approximately one hundred and forty-five degrees relative to the longitudinal axis of a respective connector link 240.

The connector links 240 have rearward ends 245 which are movably connected to the frame 110. In particular, right and left constraints 250 are rotatably mounted on opposite sides of the block 156. As shown in FIG. 8, the constraints 250 pivot about a common "guide" axis Z8 relative to the block 156. The constraints 250 may be described as rocker links which are connected in telescoping fashion to "tubular" portions of respective connector links 240. The rearward ends 245 of the connector links 240 are constrained to pivot about the axis Z9 (together with respective constraints 250) but are free to move in a radial direction relative to both the axis Z8 and the constraints 250. As a result, rotation of the cranks 130 and 132 is linked to rotation of the connector link ends 245 together with the constraints 250, and translation of the connector link ends 245 relative to the constraints 250, and also, to generally elliptical movement of the foot supports 241 relative to the frame 110.

The same adjustment assembly 160 is provided to adjust the exercise motion generated by the second embodiment 200. The motor 165 selectively rotates the worm gear 166, which in turn, moves the block 156 along the rail 117. The motor 165 may operate in response to an input signal from a person or in response to a control signal from another source.

Although the present invention has been described with reference to specific embodiments and particular applications, those skilled in the art will recognize additional embodiments, modifications, and/or applications which fall within the scope of the present invention. Accordingly, the scope of the present invention is to be limited only to the extent of the claims which follow.

What is claimed is:

1. A semi-recumbent exercise apparatus, comprising:

a frame designed to rest upon a floor surface;

a back support mounted on said frame and inclined relative to the floor surface;

left and right cranks rotatably mounted on said frame and rotatable about a common crank axis;

left and right rigid connector links, wherein an intermediate portion of each of said links is rotatably connected to a respective crank, and a first end of each of said links supports a respective foot of a person resting in supine fashion against said back support, and a second, opposite end of each of said links is movably connected to the frame in such a manner that rotation of said cranks is linked to motion of each said opposite end through a generally elliptical path having a major axis which extends generally perpendicular to the floor surface.

2. The semi-recumbent exercise apparatus of claim 1, wherein a guide axis is defined between said frame and each said opposite end, and said guide axis is selectively movable relative to said crank axis to adjust said motion of each said opposite end.

3. The semi-recumbent exercise apparatus of claim 2, wherein a motorized worm gear is interconnected between said guide axis and said frame, and rotation of said worm gear causes said guide axis to move relative to said frame.

4. The semi-recumbent exercise apparatus of claim 2, wherein each said opposite end is constrained to pivot about said guide axis but free to translate relative to said guide axis.

5. The semi-recumbent exercise apparatus of claim 4, wherein each said opposite end is connected in telescoping fashion to a roller rotatably connected to said frame at said guide axis.

6. The semi-recumbent exercise apparatus of claim 4, wherein each said opposite end is connected in telescoping fashion to a rocker link rotatably connected to said frame at said guide axis.

7. The semi-recumbent exercise apparatus of claim 1, wherein each said opposite end is connected in telescoping fashion to a roller rotatably connected to said frame at said guide axis.

8. The semi-recumbent exercise apparatus of claim 1, wherein each said opposite end is connected in telescoping fashion to a rocker link rotatably connected to said frame at said guide axis.

9. The semi-recumbent exercise apparatus of claim 1, wherein said back support defines an angle of approximately one hundred and thirty-five degrees relative to the floor surface.

10. The semi-recumbent exercise apparatus of claim 1, further comprising a flywheel rotatably mounted on said frame and operatively connected to at least one of said cranks.

11. A semi-recumbent exercise apparatus, comprising:

a frame designed to rest upon a floor surface;

a body support mounted on said frame and providing a back supporting surface;

left and right cranks rotatably mounted on said frame and rotatable about a common crank axis;

left and right connector links having first portions connected to respective cranks, and second portions configured to support respective feet of a person occupying a supine position relative to said body support and distal third portions; and left and right means, interconnected between said frame and said third portions of respective connecting links, for constraining said third portions of said connecting links to move through respective elliptical paths during rotation of said first portions about said crank axis, so that said second portions move through respective elliptical paths during rotation of said first portions about said crank axis.

12. The semi-recumbent exercise apparatus of claim 11, wherein left and right connection points are defined between said frame and respective means, and said connection points are selectively movable relative to said frame to change said fixed paths traveled by said third portions of said connecting links.

13. The semi-recumbent exercise apparatus of claim 11, wherein each said means includes a roller rotatably connected to said frame and connected in telescoping fashion to a respective one of said connecting links.

14. The semi-recumbent exercise apparatus of claim 11, wherein each said means includes a rocker link rotatably connected to said frame and connected in telescoping fashion to a respective one of said connecting links.

15. The semi-recumbent exercise apparatus of claim 11, wherein said connecting links extend generally parallel to the floor surface, and said second portions of said connecting links move generally perpendicular to the floor surface.

16. The semi-recumbent exercise apparatus of claim 15, wherein said back supporting surface defines an angle of approximately one hundred and thirty-five degrees relative to the floor surface.

17. The semi-recumbent exercise apparatus of claim 15, wherein left and right connection points are defined between said frame and respective means, and said connection points are selectively movable in a generally horizontal direction relative to said frame to change said fixed paths traveled by said third portions of said connecting links.

18. The semi-recumbent exercise apparatus of claim 17, wherein each said means includes a roller rotatably connected to said frame and connected in telescoping fashion to a respective one of said connecting links.

19. The semi-recumbent exercise apparatus of claim 17, wherein each said means includes a rocker link rotatably connected to said frame and connected in telescoping fashion to a respective one of said connecting links.

20. A method of constraining a person's feet to move through respective elliptical paths of motion while supporting the person's torso at an angle relative to an underlying floor surface, comprising the steps of:

mounting an inclined back support on a frame;

rotatably mounting left and right cranks on the frame generally beneath a forward end of the back support;

connecting intermediate portions of left and right connector links to respective cranks;

mounting left and right foot supports on forward ends of respective connector links; and constraining rearward ends of the connector links to move through respective fixed paths relative to a portion of the frame disposed generally rearward of the cranks.

* * * * *